US005714996A

United States Patent [19]

Hodai

[11] Patent Number: 5,714,996

[45] Date of Patent: Feb. 3, 1998

[54] THERMAL PRINTER INK RIBBON CASSETTE APPARATUS

[75] Inventor: Masato Hodai, Tokyo, Japan

[73] Assignee: Kabushiki Kaisha Sato, Japan

[21] Appl. No.: 394,828

[22] Filed: Feb. 27, 1995

[30] Foreign Application Priority Data

Mar. 25, 1994 [JP] Japan ..... 6-077793

[51] Int. Cl.[6] ..... B41J 32/00; B41J 35/08

[52] U.S. Cl. ..... 347/217; 347/214; 400/207; 400/208; 400/208.1; 400/234

[58] Field of Search ..... 347/214, 217; 400/207, 208, 208.1, 234

[56] References Cited

U.S. PATENT DOCUMENTS 4,527,172 7/1985 Nagashima et al. ..... 347/217

*Primary Examiner*—Huan H. Tran

*Attorney, Agent, or Firm*—Ostrolenk, Faber, Gerb & Soffen, LLP

[57] ABSTRACT

An ink ribbon cassette apparatus which eliminates slack in an ink ribbon when the ink ribbon cassette is loaded on a printer. The ink ribbon is supplied from a supply reel and taken up on a take-up reel both supported on the cassette. A detector detects when the cassette is loaded on the cassette apparatus and in turn drives the take-up reel to draw a short length of the ink ribbon onto the take-up reel. The rotatable supply member is restrained by spring tension from rotating and from supplying the ribbon, providing a back tension on the ink ribbon and preventing slack.

15 Claims, 14 Drawing Sheets

THERMAL PRINTER INK RIBBON CASSETTE APPARATUS

BACKGROUND OF THE INVENTION

1. Field of the Invention

The present invention relates to a thermal printer in which printing of a print medium such as a tag, label or the like is effected by a thermal print head pressed into contact with the print medium with an ink ribbon therebetween. More particular, it relates to an improved ink ribbon cassette apparatus that enables the automatic elimination of slack in an ink ribbon when an ink ribbon cassette is loaded on a thermal printer.

2. Description of the Prior Art

JP-A HEI 4-299170 discloses an example of this type of ink ribbon cassette apparatus for use in a thermal printer. In this arrangement, as shown in FIGS. 14 and 15, an ink ribbon cassette 6 having a ribbon supply reel 4 and a ribbon take-up reel 5 for taking up a ribbon (hot shown) is detachably attachable to a thermal printing apparatus 1 by means of cassette support spindles 2 and 3 on the apparatus 1 which can be removably inserted into guide channels 7 and 8 in the ink ribbon cassette 6.

However, the ribbon cassette thus configured does not allow any slack in the ribbon to be automatically removed simply by loading the ribbon cassette onto the thermal printing apparatus. Slack therefore has to be eliminated after the ribbon cassette has been loaded onto the thermal printing apparatus, by slightly rotating the ribbon take-up reel manually or mechanically. Thus, it is not possible to replace a ribbon cassette quickly and easily.

An object of the present invention is to provide a thermal printer ink ribbon cassette apparatus that is provided with a detection mechanism for detecting that an ink ribbon cassette has been loaded on the thermal printer and an ink ribbon take-up member drive mechanism that based on the detection output of the detection means rotates the take-up member in the take-up direction by a prescribed amount, to thereby automatically enable the elimination of slack arising in an ink ribbon when an ink ribbon cassette is loaded in a thermal printer.

SUMMARY OF THE INVENTION

To attain the above object, the present invention provides a thermal printer ink ribbon cassette apparatus in which an ink ribbon cassette having an ink ribbon supply member and an ink ribbon take-up member for taking up ribbon from the ink ribbon supply member is detachably fitted to a thermal printer in which printing of a print medium such as a tag is effected by a thermal print head pressed against the print medium with an ink ribbon therebetween, characterized in that the ink ribbon cassette apparatus is provided with a detection mechanism for detecting that an ink ribbon cassette has been loaded on the thermal printer, and is also provided with an ink ribbon take-up member drive mechanism that based on the detection output of the detection means rotates the take-up member in the take-up direction by a prescribed amount.

In accordance with this invention, the fact that an ink ribbon cassette has been (detachably) loaded on the thermal printer is detected by a detection mechanism. The detection output thus produced causes an ink ribbon drive mechanism to rotate the ribbon take-up member in the take-up direction by a prescribed amount. This enables any slack in the ribbon to be eliminated automatically. This arrangement therefore enables thermal printer ribbon cassettes to be replaced quickly and easily.

The above and other features of the present invention will become apparent from the following description made with reference to the drawings.

BRIEF DESCRIPTION OF THE DRAWING(S)

DESCRIPTION OF THE PREFERRED EMBODIMENTS

Figure 1:
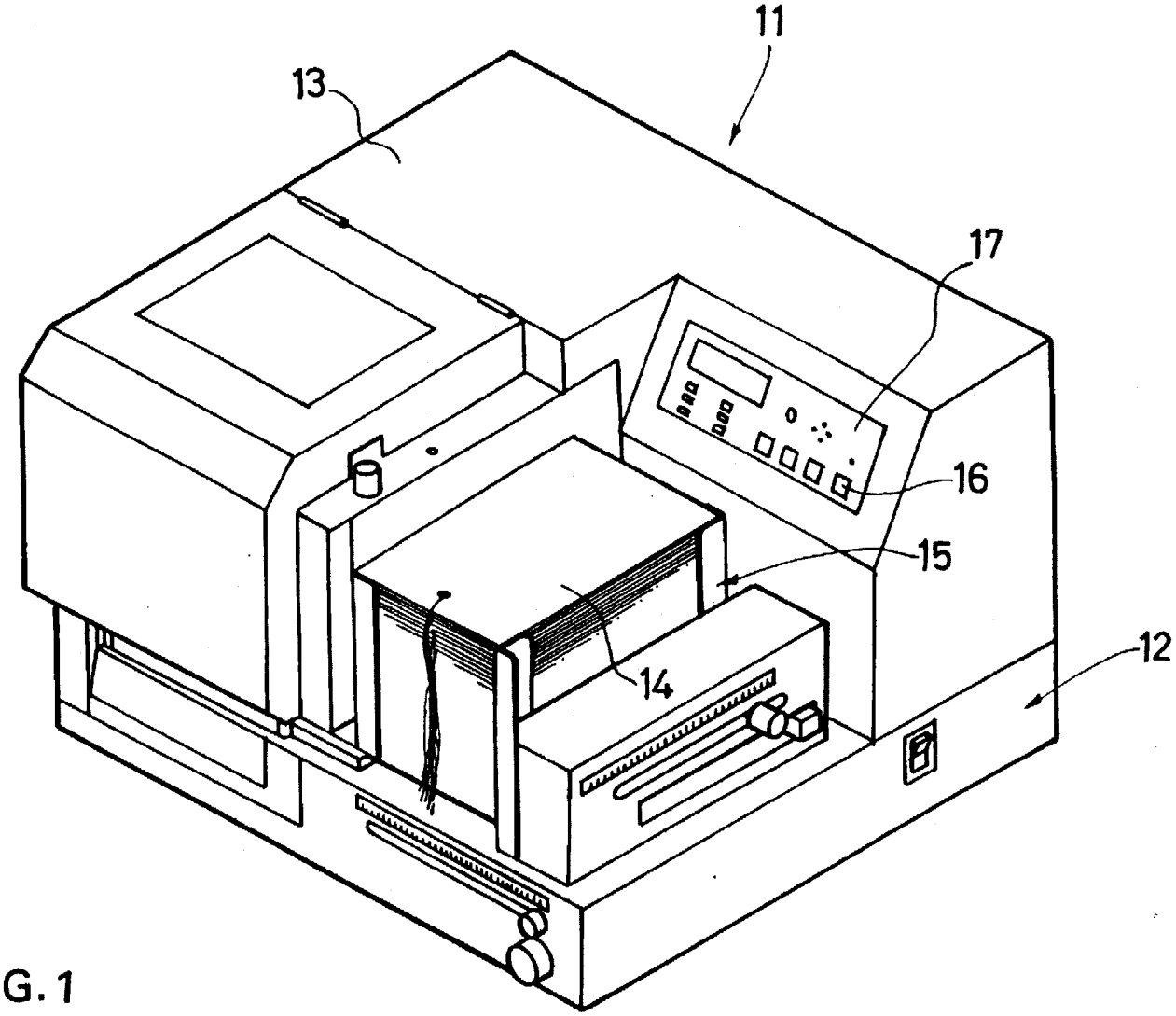
FIG. 1 is an external perspective view of a thermal printer according to this invention.

FIG. 1 shows an external perspective view of a thermal printer 11 in which an ink ribbon cassette apparatus according to the present invention is applied. The thermal printer 11 has a main unit 12, a main unit cover 13, and a hopper 15 containing a stack of tie tags 14 to be printed. The printed cover 13 has an operating panel 17 with operating switches 16.

Figure 2:
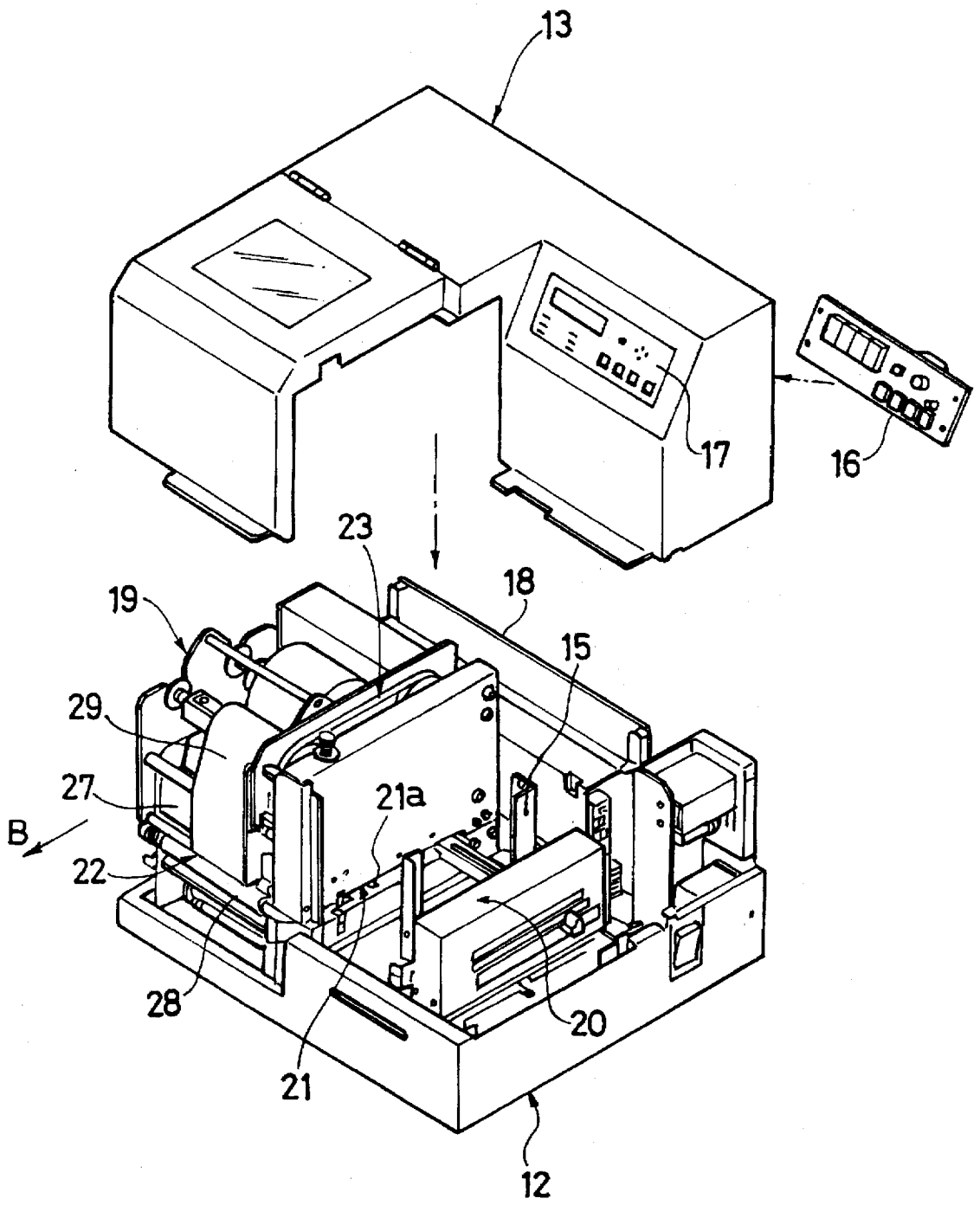
FIG. 2 is a perspective view of a thermal printer of this invention with the cover removed.

FIG. 2 is a perspective view showing the thermal printer 11 with the cover 13 removed, exposing the printer main unit 12. The main unit 12 has an electronic control section 18, and ink ribbon cassette 19, a tag transfer-claw drive 20, a tag transport drive 21, a thermal printing mechanism 22 and a cassette drive 23.

Figure 3:
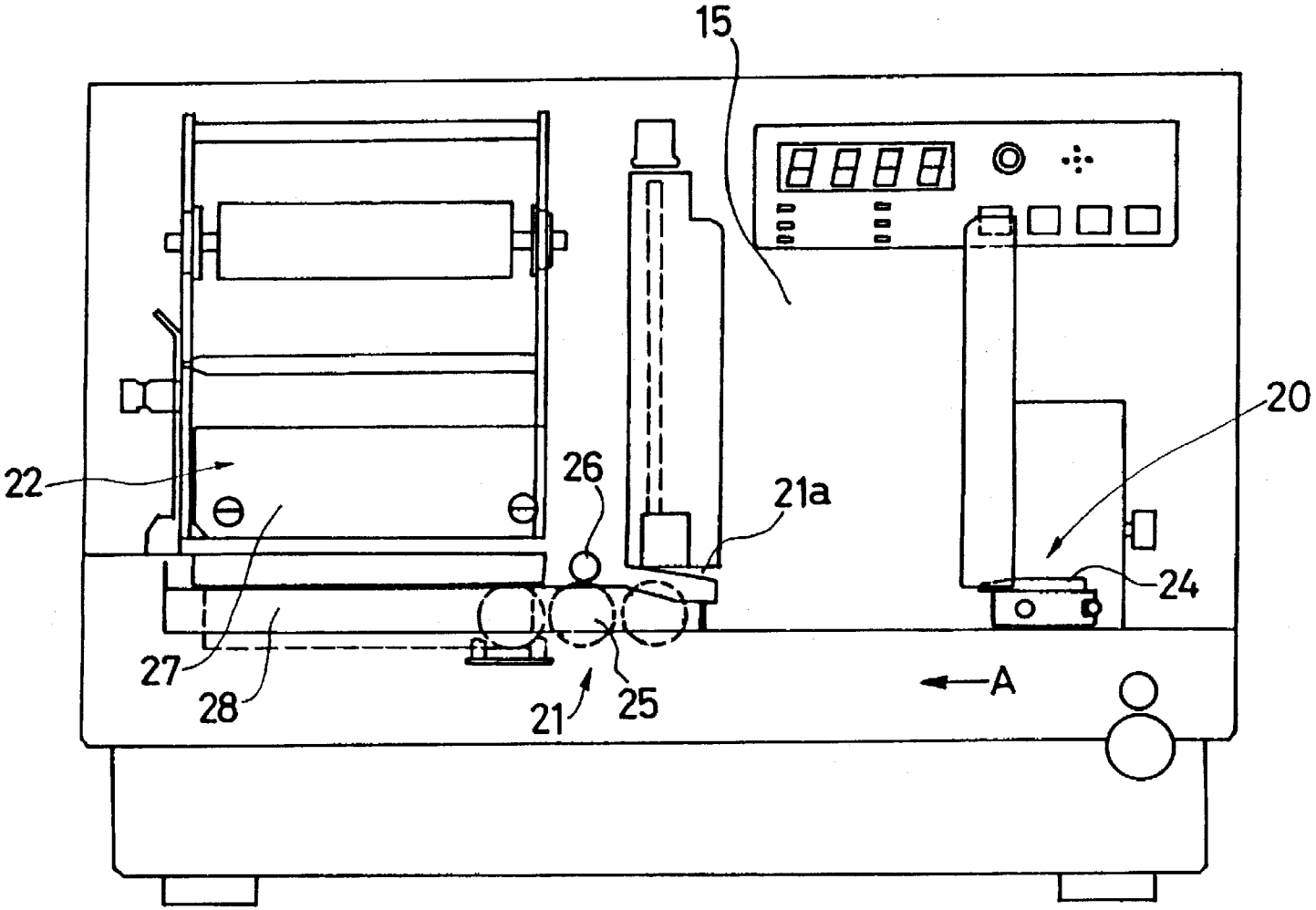
FIG. 3 is a schematic front view of the thermal printer of the invention.

The printing operation of the above thermal printer will now be described with reference to FIGS. 1 to 3.

A prescribed switch 16 is closed to activate the electronic control section 18 and start the tag transfer-claw drive 20. This causes a transfer claw 24 in the lower part of the hopper 15 to move in a direction indicated in FIG. 3 by A, transferring one tag 14 from the bottom of the stack in the hopper 15 into a tag input opening 21*a* where the tag 14 is gripped between transfer rollers 25 and a pinch roller 26. The rotation of the transfer rollers 25 and pinch roller 26 feeds the tags 14 between a platen roller 28 and a print head 27 constituting a thermal printing mechanism 22. When the arrival of the tag 14 at this position is detected by a sensor (not shown), the thermal printing mechanism 22 is activated, pressing the thermal print head 27 against the tag 14 with an ink ribbon 29 of the ink ribbon cassette 19 therebetween. The platen roller 28 then rotates to move the tag 14 forward with respect to the main unit 12 (in the direction indicated in FIG. 2 by B). The tag 14 is printed as it is thus moved forward, and is then ejected from a tag ejection section The ink ribbon cassette apparatus that forms the gist of this invention will now be described.

Figure 10:
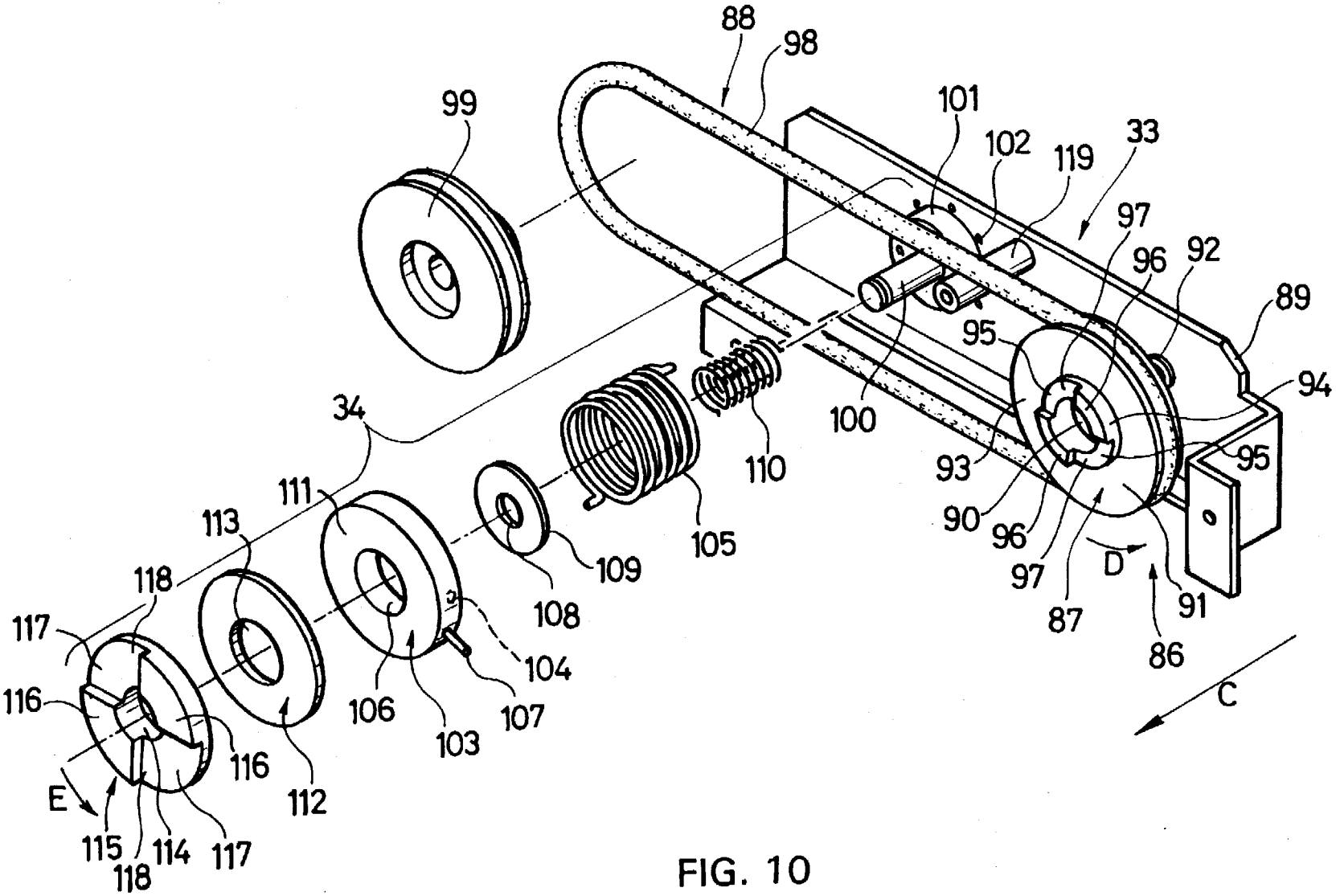
FIG. 10 is a perspective view of an ink ribbon drive mechanism and back-tension mechanism according to the invention.

The ink ribbon cassette apparatus comprises the ink ribbon cassette 19 that holds the ink ribbon 29 (FIG. 4), a cassette mounting mechanism 31, provided on the main unit 12, on which the ink ribbon cassette 19 is detachably mounted (FIG. 7), a detection mechanism that detects the loading of the ink ribbon cassette 19 on the main unit 12 (FIG. 8), an ink ribbon drive mechanism 33 for taking up a prescribed length of the ink ribbon 29 (FIG. 10), and a back-tension mechanism 34 for imparting a prescribed tension to the ribbon 29 when the ribbon is paid out (FIG. 10).

Figure 4:
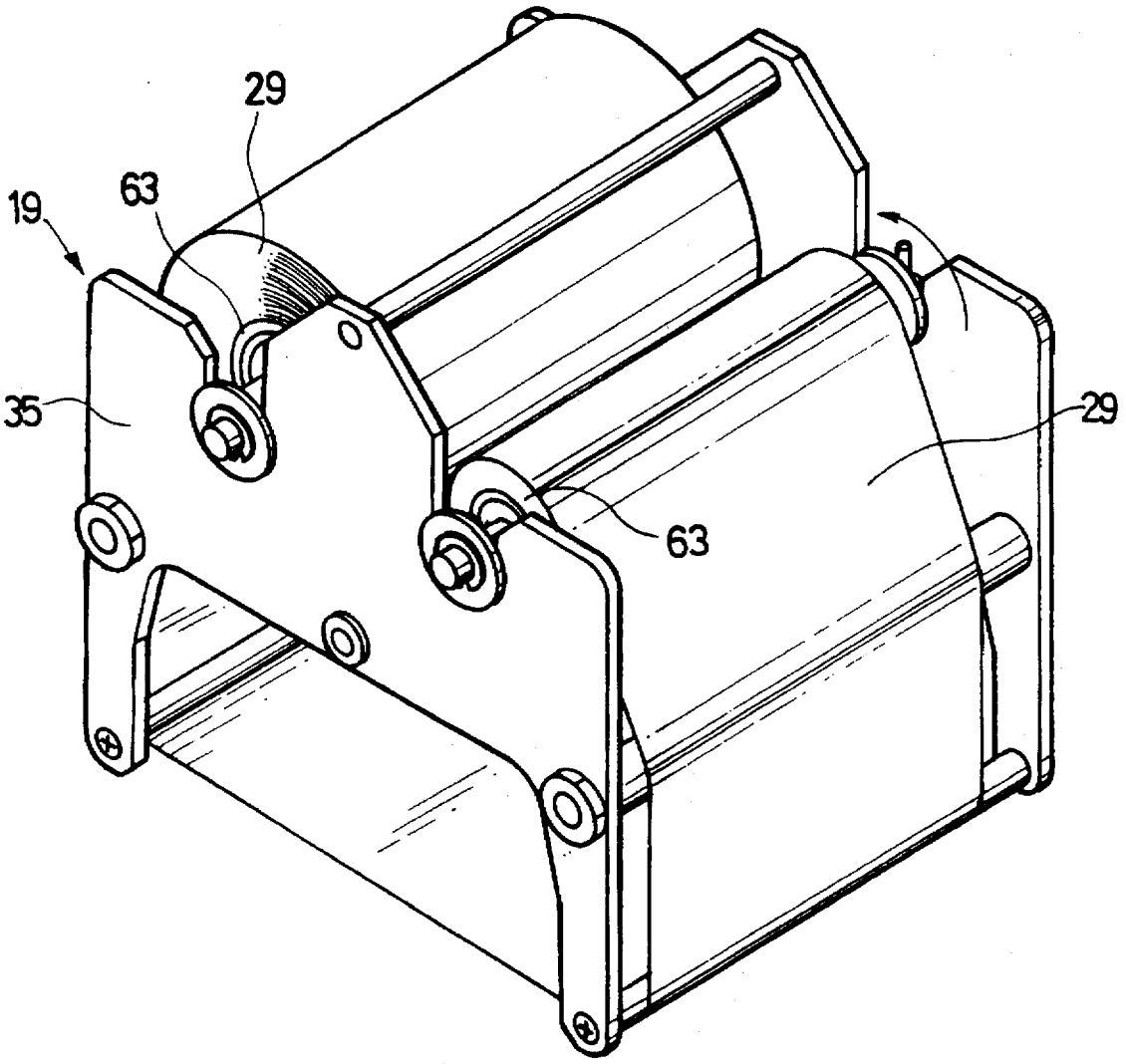
FIG. 4 is a perspective view of an ink ribbon cassette according to this invention.

The ink ribbon cassette 19 will now be described with reference to FIGS. 4 and 5. The ink ribbon cassette 19 comprises the ink ribbon 29, an ink ribbon cassette frame 35, and ink ribbon supply member 36, detachably mounted on the ink ribbon cassette frame 35, that holds a roll of ink ribbon 29, and an ink ribbon take-up member 37, detachably mounted in the ink ribbon cassette frame 35, that takes up ink ribbon 29 from the ink ribbon supply member 36.

Figure 5:
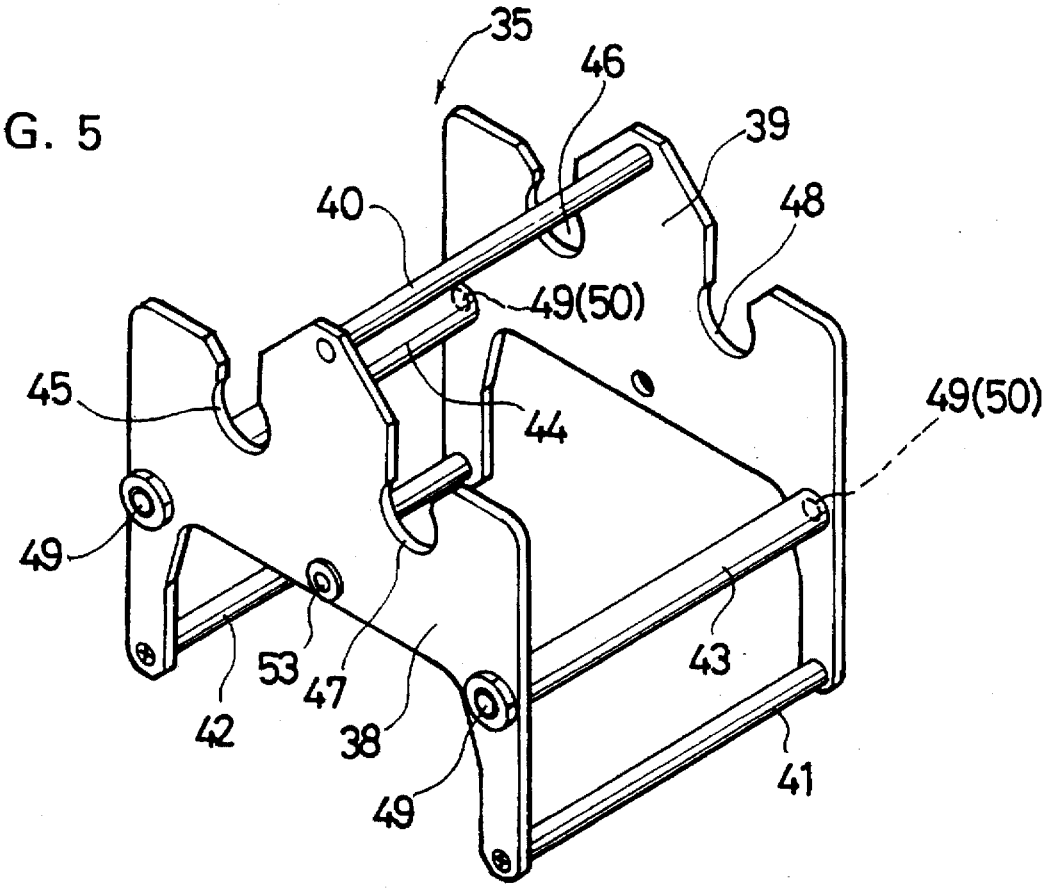
FIG. 5 is a perspective view of the frame of an ink ribbon cassette of the invention.

As shown in FIG. 5, the ink ribbon cassette frame 35 comprises front plate 38, a rear plate 39 separated from the front plate 38 by a prescribed distance, a fixing shaft 40 that fixes the upper parts of the plates 38 and 39, right and left ink ribbon 29 guide shafts 41 and 42 that fix the lower left and right parts of the plates 38 and 39, right and left engagement tubes 43 and 44 disposed over guide shafts 41 and 42 roughly midway up plates 38 and 39, and front and rear ribbon supply member mounting portions 45 and 46 formed in the upper left edges of the plates 38 and 39, and front and rear ribbon take-up member mounting portions 47 and 48 formed in the upper right edges of the front and rear plates 38 and 39.

The right and left engagement tubes 43 and 44 are hollow and have openings 49 formed at each end in the front and rear plates 38 and 39. The openings 49 on the rear plate 39 constitute openings 50 for the insertion of right and left engagement shafts 74 and 75, as explained below. Reference number 53 denotes a screw hole for a fixing screw 52 of a cassette bracket 51, described below.

Figure 6:
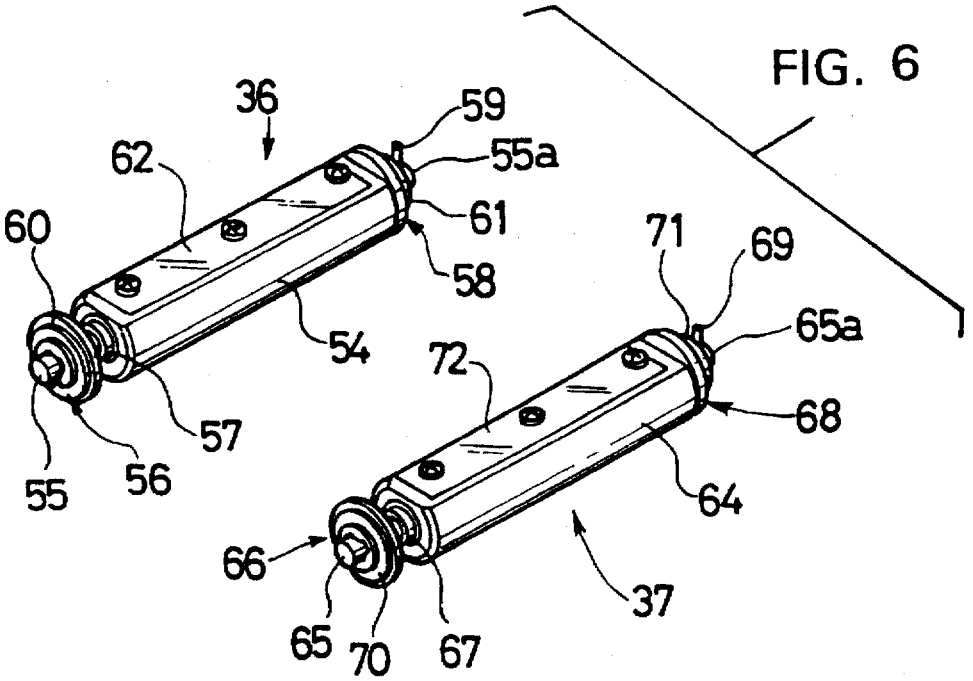
FIG. 6 is a perspective view of ink ribbon take-up and supply members according to the invention.

As shown in FIG. 6, ink ribbon supply member 36 comprises cylindrical ribbon supply member body 54, a mounting shaft 55 that retractably protrudes from one end of the ribbon supply member body 54, a front engaging disk 56 rotatably mounted on the end of the mounting shaft 55, a coil spring 57 that urges the front engaging disk 56 and mounting shaft 55 away from the ribbon supply member body 54, a mounting shaft 55*a* that protrudes from the other end of the ribbon supply member body 54, a rear engaging disk 58 rotatably provided on the mounting shaft 55*a*, and an engaging pin 59 located on the outer side of the rear engaging disk 58 and affixed on the end of the mounting shaft 55*a* perpendicularly to the axis of the shaft 55*a*.

The outer side of the front engaging disk 56 is stepped inwards around the periphery thereof to form a stepped engaging portion 45 on the front plat 38 of the ink ribbon cassette frame 35. The outer side of the rear engaging disk 58 is also stepped inwards around the periphery thereof to form a stepped engaging portion 61 that detachably engages in the rear ribbon supply member mounting portion 46 on the rear plate 39.

A flat spring 62 is provided on the outer surface of the ink ribbon supply member 36. When a cylinder 63 formed of paper, plastic or the like carrying a roll of ink ribbon 29 is set in place, the urging force of the free end (not shown) of the flat spring 62 against the inside surface of the cylinder 63 serves to maintain the cylinder 63 on the ribbon supply member body 54.

After completion of printing the ink ribbon 29 is taken up on cylinder 63 by the ink ribbon take-up member 37, which has the same configuration as the ink ribbon supply member 36. Thus, the ink ribbon take-up member 37 comprises a cylindrical ribbon take-up member body 64, a mounting shaft 65 that retractably protrudes from one end of the ribbon take-up member body 64, a front engaging disk 66 rotatably mounted on the end of the mounting shaft 65, a coil spring 67 that urges the front engaging disk 66 and mounting shaft 65 away from the ribbon take-up member body 64, a mounting shaft 65*a* that protrudes from the other end of the ribbon take-up member body 64, a rear engaging disk 68 rotatably provided on the mounting shaft 65*a*, and an engaging pin 69 located on the outer side of the rear engaging disk 68 and affixed on the end of the mounting shaft 65*a* perpendicularly to the axis of the shaft 65*a*.

The outer side of the front engaging disk 66 is stepped inwards around the periphery thereof to form a stepped engaging portion 70 that detachably engages in the front ribbon take-up member mounting portion 47 on the front plate 38 of the ink ribbon cassette frame 35. The outer side of the rear engaging disk 68 is also stepped inwards around the periphery thereof to form a stepped engaging portion 71 that detachably engages in the rear ribbon take-up member mounting portion 48 on the rear plate 39.

A flat spring 72 is provided on the outer surface of the ribbon take up member body 64. When a cylinder 63 carrying ink ribbon 29 is set in place, the urging force of the free end (not shown) of the flat spring 72 against the inside surface of the cylinder 63 serves to maintain the cylinder 63 on the ribbon supply member body 64.

The cassette mounting mechanism 31 on which the ink ribbon cassette 19 is detachably mounted will now be described with reference to FIG. 7. The cassette mounting mechanism 31 comprises a cassette mounting frame 73, right and left engagement shafts 74 and 75 are provided a prescribed distance apart on the cassette mounting frame 73 with their axes disposed horizontally in parallel. The right and left engagement tubes 43 and 44 on the ink ribbon cassette frame 35 can receive inserted into them the engagement shafts 74 and 75. The right and left engagement shafts 74 and 75 have pointed ends to facilitate insertion into the openings 50 of the right and left engagement tubes 43 and 44. The lower end of the cassette bracket 51 is pivotally affixed to the front end of the cassette mounting frame 73. The cassette bracket 51 has a centrally located fixing screw 52 arranged so that it can be screwed into the screw hole 53 in the front plate 38.

Figure 8:
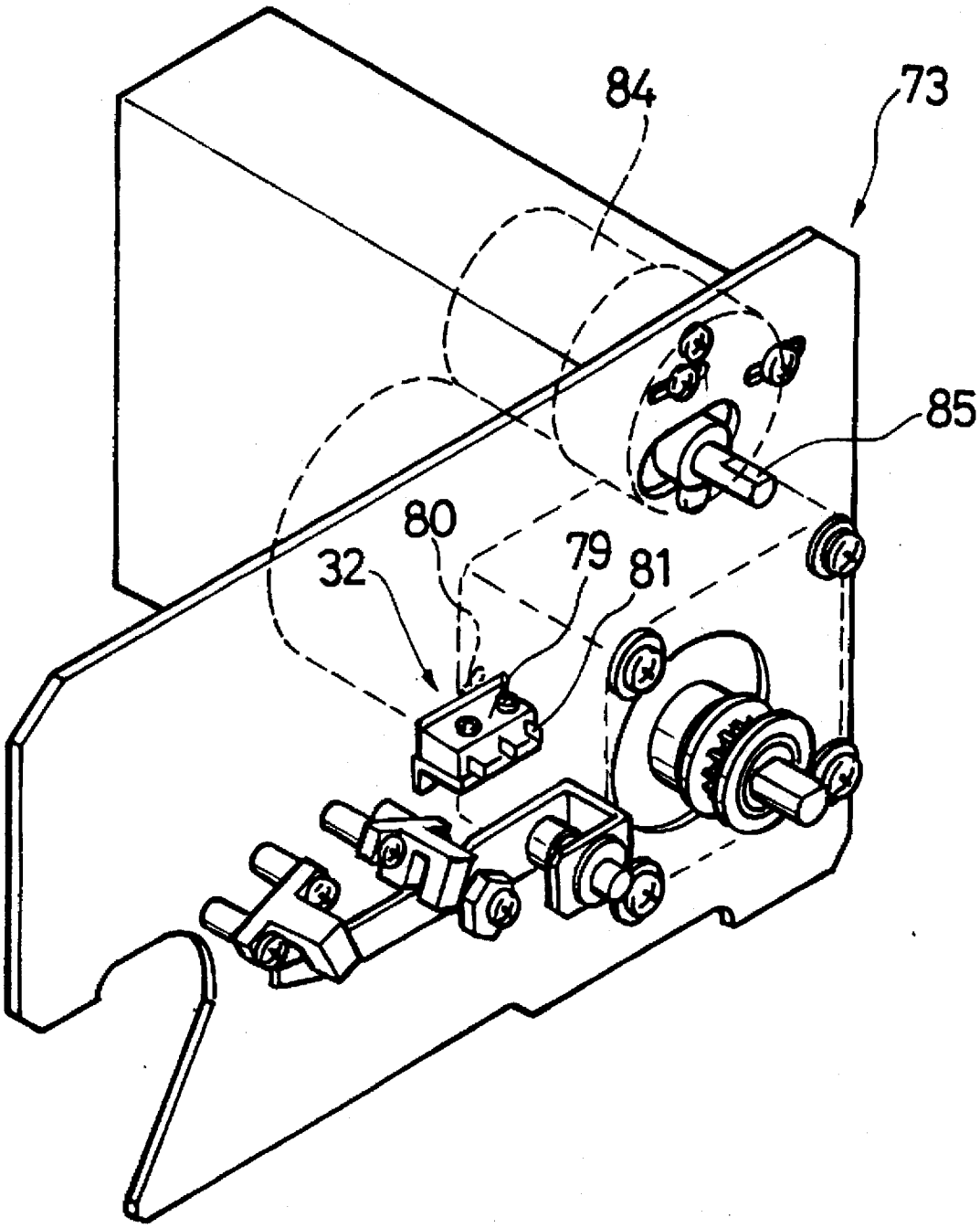
FIG. 8 is a perspective view showing the arrangement of a detection mechanism on a cassette mounting frame, in accordance with the invention.
Figure 9:
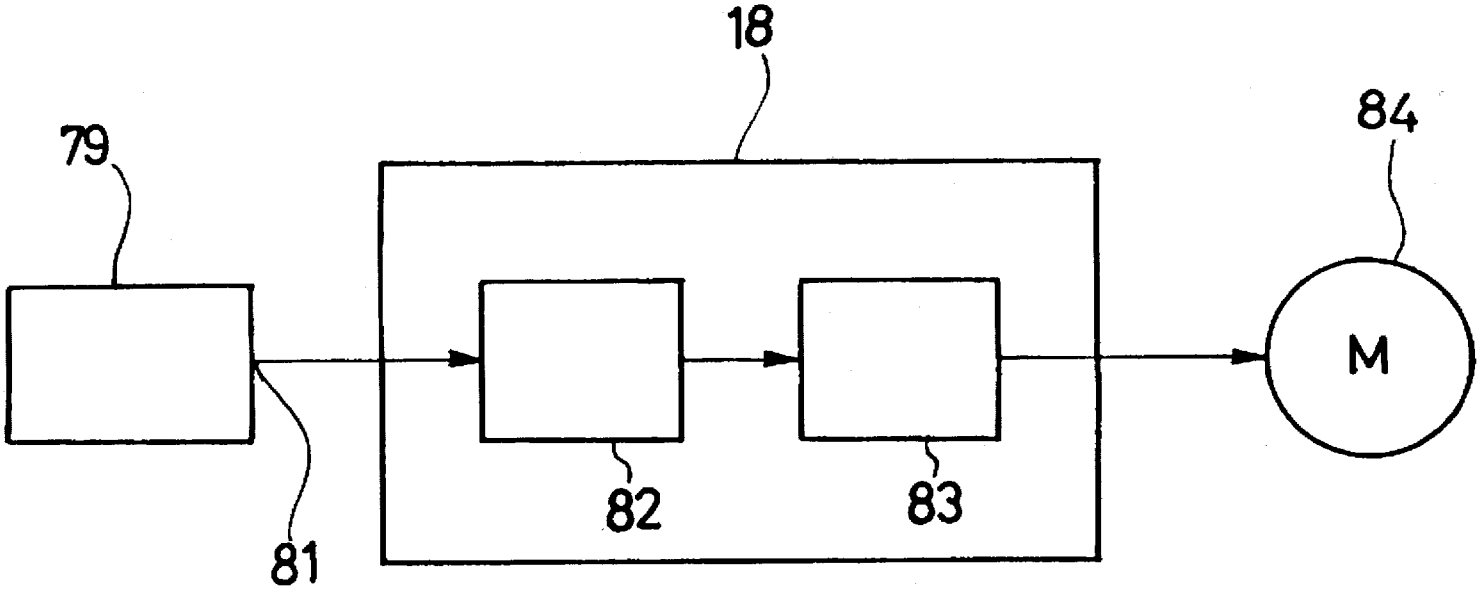
FIG. 9 is a block diagram showing an arrangement of an electronic control section according to the invention.

Also formed in the cassette mounting frame 73 are a pair of round holes 76 and 77 and limit switch mounting hole 78. As show in FIG. 8, a detection mechanism 32 constituted by a limit switch 79 is mounted in the hole 78. The limit switch 79 is for detecting the mounting of an ink ribbon cassette 19 on the cassette mounting frame 73. For this, the limit switch 79 has an activating lever 80 that projects slightly inward from the surface of the inner wall of the cassette mounting frame 73 (to the left, with reference to FIG. 7). The limit switch 79 is arranged so that mounting the ink ribbon cassette 19 on the cassette mounting frame 73 brings the rear plate 39 of the ink ribbon cassette frame 35 into contact with the activating lever 80. As shown by FIG. 9, the output 81 of the limit switch 79 is input to a CPU 82 of the electronic control section 18. The output of the CPU 82 is connected to the input of a drive motor controller 83. The output of the drive motor controller 83 is input to a drive motor 84 mounted at a prescribed location on the cassette mounting frame 73. As shown by FIG. 8, the drive shaft 85 is input to a drive motor 84 projects from the outer surface of the cassette mounting frame 73. A drive reel 99, shown in FIG. 10, is mounted on the drive shaft 85.

When the limit switch activating lever 80 is pressed by the rear plate 39 of the ink ribbon cassette frame 35, limit switch 79 produces an output that is input to the drive motor controller 83 via the CPU 82, causing the drive shaft 85 to rotate a prescribed amount of degrees.

The ink ribbon drive mechanism 33 will now be described with reference to FIG. 10.

The ink ribbon drive mechanism 33 consists of an ink ribbon take-up mechanism 86 and a back-tension mechanism 34. The ink ribbon take-up mechanism 86 is comprised of an ink ribbon take-up reel mechanism 87 and a reel drive mechanism 88.

In FIG. 10, reference numeral 89 denotes a ribbon drive frame mounted on the main unit 12 adjacent to the cassette mounting frame 73. The ribbon drive frame 89 is provided with an ink ribbon take-up mechanism 86 is comprised of an ink ribbon take-up reel mechanism 87 and a reel drive mechanism 88.

In FIG. 10, reference numeral 89 denotes a ribbon drive from mounted on the main unit 12 adjacent to the cassette mounting frame 73. The ribbon drive frame 89 is provided with an ink ribbon take-up mechanism 86 and a back-tension mechanism 34. The ink ribbon take-up mechanism 87 is comprised of a mounting shaft 90 affixed to the ribbon drive frame 89 so that it projects along the central axis of the hole 76 in the cassette mounting frame 73, a take-up member drive reel 91 located in the hole 76, the reel 91 being rotatably mounted on the shaft 90 so that it can be moved along the axis of the shaft 90, a coil spring 92 that urges the take-up member drive reel 91 away from the ribbon drive frame 89, that is, in the direction indicated in FIG. 10 by C, and a stop (not shown) for positioning the take-up member drive reel 91 on the end of the mounting shaft 90. An annular ridge 94 is formed around the center of one side of the take-up member drive reel 91. The annular ridge 94 is comprised of a pair of opposed first stepped portions 95, and a pair of second stepped portions 96 between the first stepped portions 95. The second stepped portions 96 are slightly higher than the first stepped portions 95. Between each first stepped portion 95 and second stepped portion 96 is a recess 97 for engagement with the pin 69 on the ink ribbon take-up member 37. In the initial state, when the take-up member drive reel 91, specifically the annular ridge 94 thereof, is not in contact with the engaging pin 69 the urging of the coil spring 92 causes the annular ridge 94 to project slightly inward from the inner wall of the cassette mounting frame 73.

The reel drive mechanism 88 comprises a rubber transmission belt 98 and the above drive motor 84 and drive reel 99. One end of the belt 98 is mounted around the drive reel 99 on the drive shaft 85 to thereby transmit the driving force of the motor 84 to the take-up member drive reel 91, whereby the take-up member drive reel 91 is rotated in the ink ribbon take-up direction, indicated in FIG. 10 by D.

With the engaging pin 69 of the ink ribbon take-up member 37 arranged in the ink ribbon cassette 19 pressing on the annular ridge 94 against the resistance of the coil spring 92, when the take-up member drive reel 91 is moved in direction C and the driving force of drive motor 84 is transmitted to the take-up member drive reel 91 via the transmission belt 98, rotating the reel 91 in direction D, the associated rotation of the annular ridge 94 causes the engaging pin 69 that was in contact with the first stepped portion 95 to engage with pin engagement recess 97 under the urging of the coil spring 92. Thus, by means of the engaging pin 69 the rotation of the take-up member drive reel 91 is transmitted to the ink ribbon take-up member 37.

The back-tension mechanism 34 will now be described with reference to FIG. 10. The back-tension mechanism 34 imparts a prescribed braking force to the rotation of the ink ribbon supply member 36 in the direction in Which ribbon is supplied, thereby imparting a prescribed tension to the ink ribbon 29. The back-tension mechanism 34 is comprised of a projecting mounting shaft 100 affixed to the ribbon drive frame 89 so that it projects along the central axis of the hole 77 in the cassette mounting frame 73, and, arranged axially on the mounting shaft 100, a tension spring fixing collar 101 affixed to the ribbon drive frame 89, a plurality of tension spring anchor holes 102 provided equidistantly in the ribbon drive frame 89 around the periphery of the tension spring fixing collar 101 to adjust the tension of a tension spring 105 described below, a tension spring 105 coiled around the tension spring fixing collar 101 with one end in an anchor hole 102 and the other end in engagement with a hole 104 of a tension engagement member 103, described below, whereby rotation of the tension engagement member 103 in both the clockwise and counter-clockwise directions is restricted by the force of the spring, a disk-shaped tension engagement member 103 having a center hole 106, a surface recess (not shown) on one side and a stop pin 107 on its peripheral surface the member 103 being rotatably mounted, via its center hole 106, on the mounting shaft 100 along which the member 103 can also move, a pressure spring fixing disk 109 having a center hole 108 via which the disk 109 is mounted on the shaft 100 in the recess of the tension engagement member 103, a coil spring 110 coiled around the mounting shaft 100 with one end anchored on the tension spring fixing collar 101 and other end anchored on the pressure spring fixing disk 109, the coil spring 110 urging the tension engagement member 103 away from the ribbon drive frame 89, a round friction member 112 of cork, felt or the like having a prescribed frictional force which is movably and rotatably mounted on the shaft 100 by means of a center hole 113, in contact with the other side of the tension engagement member 103, and a supply member engaging reel 115 which is movably and rotatably mounted on the shaft 100 by means of a center hole 114, with one side in contact with the friction member 112.

The supply member engaging reel 115 also has a pair of opposed stepped engagement portions 116 formed on the other side 117. The stepped engagement portions 116 are formed to be slightly higher than the other side 117. Between stepped engagement portion 116 and the side 117 is a pin engagement recess 118 for engagement with the engaging pin 59 on the ink ribbon supply member 36.

Figure 7:
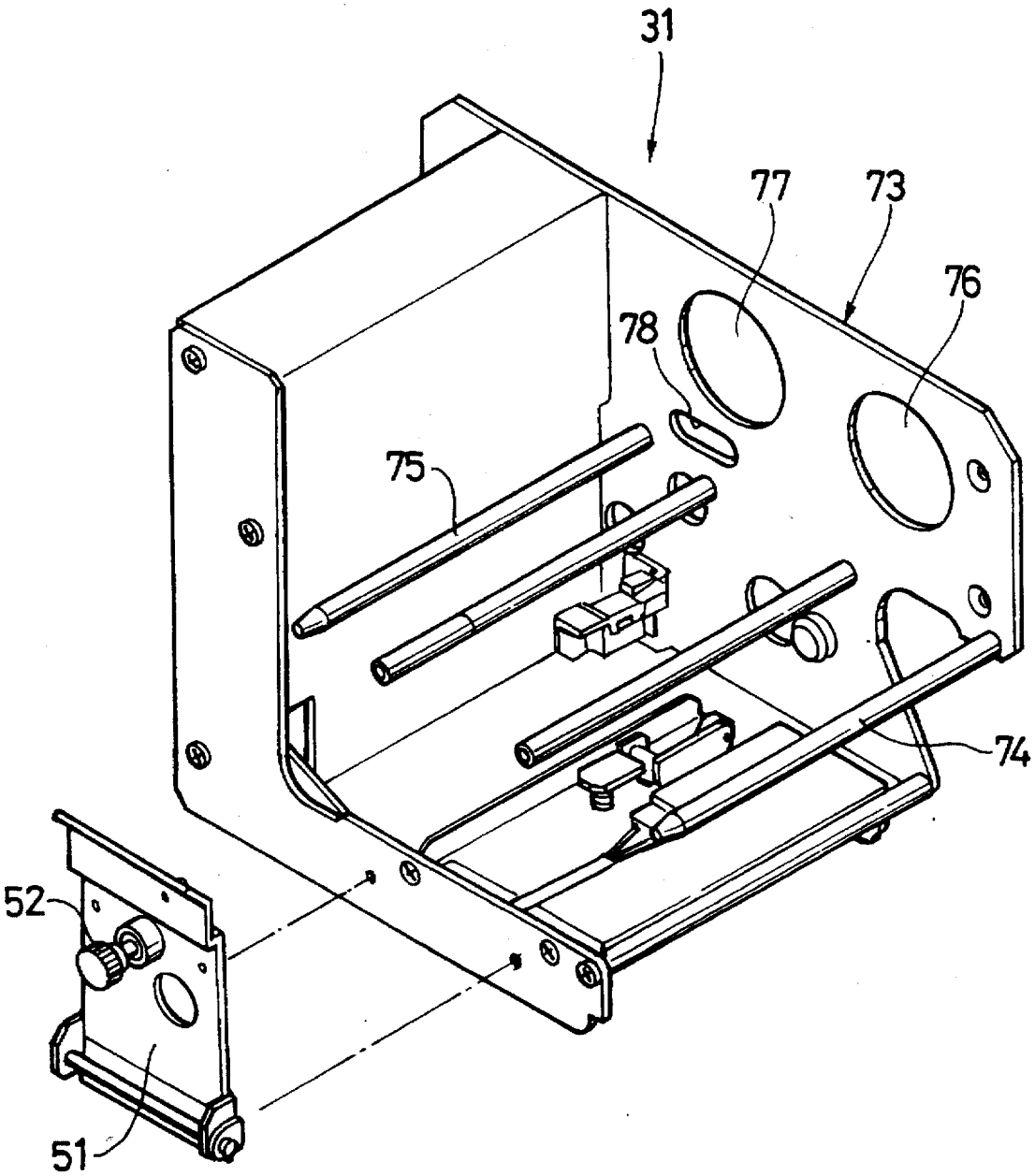
FIG. 7 is a perspective view of a cassette mounting mechanism according to the invention.

In the initial state, when the stepped engagement portions 116 are not in contaact with the engaging pin 59, the urging of the coil spring 110 causes the stepped engagement portions 116 to project slightly inward from the inner wall of the cassette mounting frame 73 (to the left, with respect to FIG. 7). The supply member engaging reel 115 moves in direction C when the engagement pin 59 of the ink ribbon supply member 36 mounted on the ink ribbon cassette frame 35, in a stepped engagement portion 116, is pushed against the urging force of the coil spring 110.

When the take-up member drive reel 91 is driven to wind the ink ribbon 29 up on the ink ribbon take-up member 37, as the ink ribbon 29 is thereby drawn from the ink ribbon supply member 36 the ink ribbon supply member 36 rotates in the front and rear mounting portions 45 and 46 of the ink ribbon cassette frame 35. This rotation together with the force of the coil spring 110 brings the engaging pin 59 of the ink ribbon supply member 36 into engagement in the recess 97 of the supply member engaging reel 115, whereby the supply member engaging reel 115 is rotated in the direction indicated in FIG. 10 by E. This rotational force is transmitted to the tension engagement member 103 by the frictional force of the friction member 112. The force exerted by the tension spring 105 as the spring is tightened by this rotation in direction E restricts rotation of the tension engagement member 103 in the direction in which ink ribbon 29 is supplied, and rotation of the supply member engaging reel 115 is also gradually restrained by the friction member 112. As a result, back-tension is imparted to the ink ribbon 29 coming from the ink ribbon supply member 36. When the force exerted to draw the ink ribbon 29 from the ink ribbon supply member 36 is greater than the force imparted by the tension spring 105, the friction member 112 will slip against the rotation of the supply member engaging reel 115, allowing the ink ribbon 29 to be drawn from the ink ribbon supply member 36.

Reference numeral 119 denotes a stop pin 119 provided on the ribbon drive frame to stop rotation of the tension engagement member 103 at a prescribed position by abutment by the stop pin 107 on the tension engagement member 103.

The operation of the ink ribbon cassette apparatus thus configured will now be described.

First, the operation of the loading ink ribbon in the ink ribbon cassette will be explained. The ink ribbon 29 is loaded as a cylindrical roll 63 of ribbon around the ink ribbon supply member 36 (FIG. 6).

The ink ribbon supply member 36 with the ink ribbon 29 is mounted on the ink ribbon supply member 36 by pushing the front engaging disk 56 toward the ink ribbon supply member 36 against the force of the spring 57 and inserting the stepped engaging portion 60 of the front engaging disk 56 in the front ribbon supply member mounting portion 45 and the stepped engaging portion 61 of the rear engaging disk 58 into the rear ribbon supply member mounting portion 46.

In the same way, the ink ribbon take-up member 37 with the cylinder 63 is mounted by fitting it into the right and left mounting portions 47 and 48. The end of the ink ribbon 29 is then drawn out of the ink ribbon supply member 36 and threaded around the left engagement tube 44, left guide shaft 42, right guide shaft 41 and right engagement tube 43 and is affixed by suitable means such as adhesive tape to the cylinder 63 of the ink ribbon take-up member 37. This completes the loading of the ink ribbon 29 in the ink ribbon cassette frame 35 (FIG. 4).

It will be assumed that there is a little slack in the ink ribbon 29 between the ink ribbon supply member 36 and the ink ribbon take-up member 37.

The mounting of the ink ribbon cassette 19 on the main unit 12 will now be described.

Figure 11:
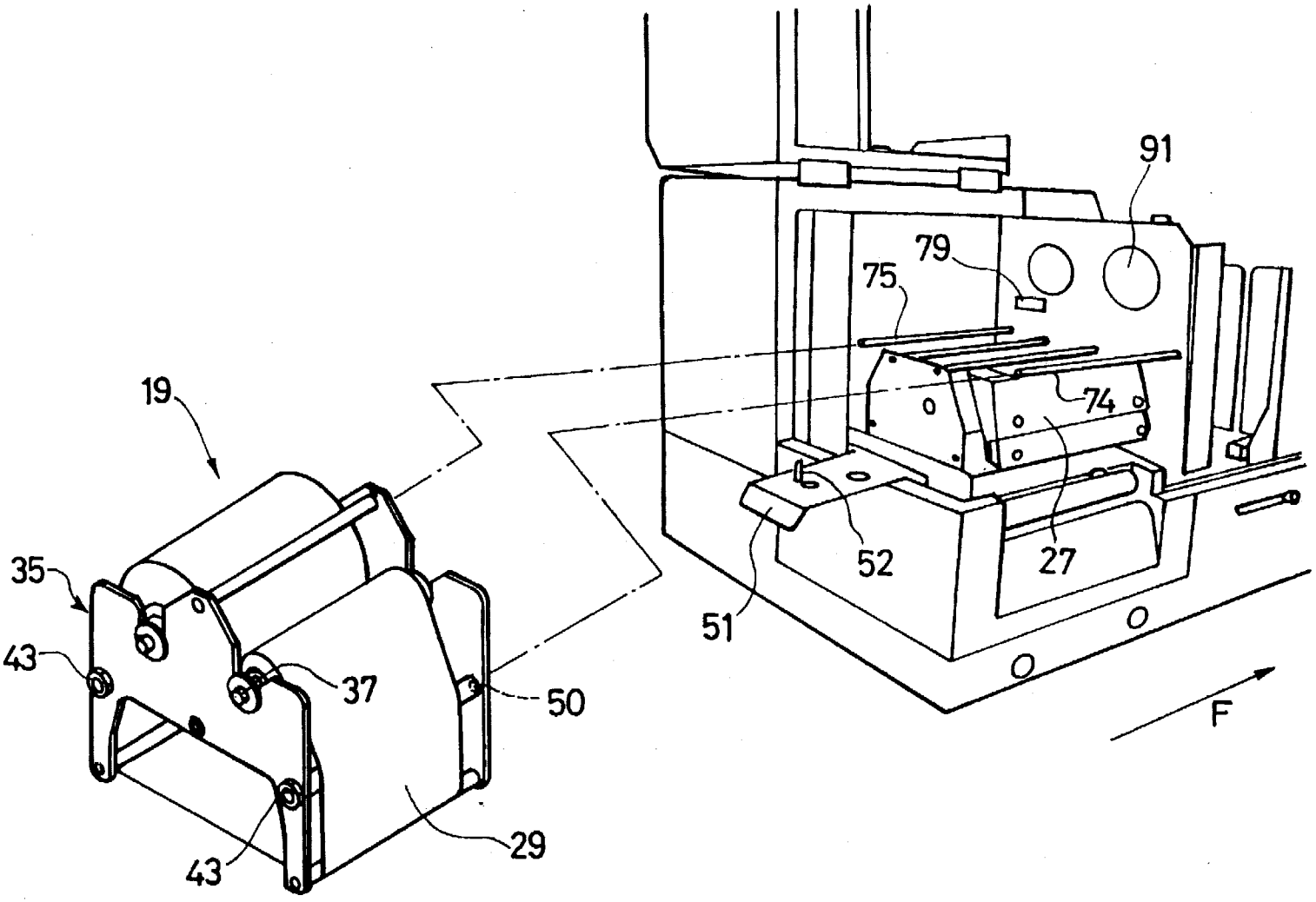
FIG. 11 is a perspective view showing a cassette prior to being mounted on the cassette mounting mechanism.
Figure 12:
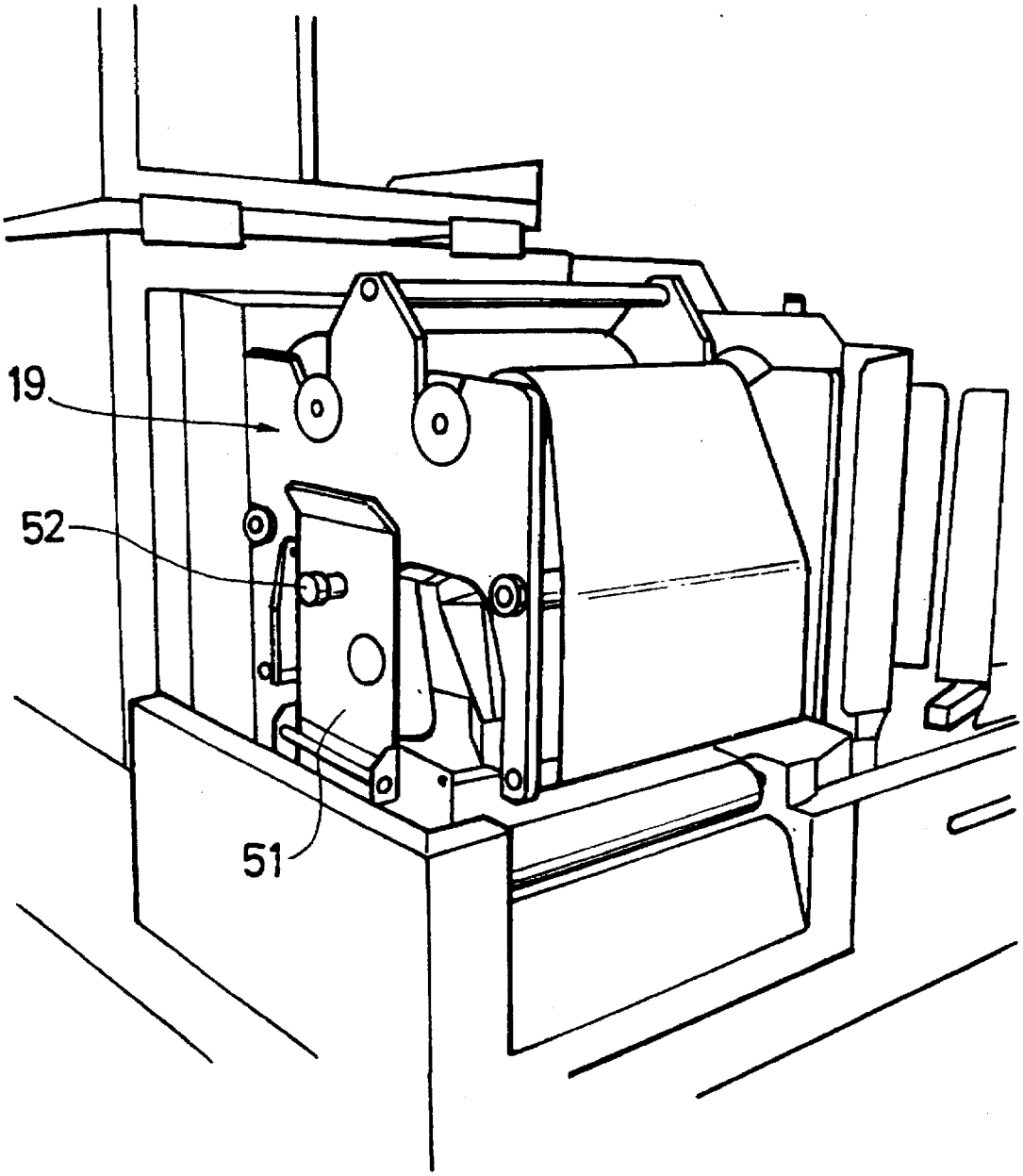
FIG. 12 is a perspective view showing the cassette in place on the cassette mounting mechanism of the invention.

For this explanation it will be assumed that the prescribed switches 16 have been closed and that the cassette bracket 51 on the cassette mounting mechanism 31 is opened to a horizontal position as shown in FIG. 11.

The ink ribbon cassette frame 35 is mounted on the printer by moving it in the direction indicated in FIG. 11 by F so as to insert the right and left engagement shafts 74 and 75 into openings 50 of right and left engagement tubes 43 and 44.

When the ink ribbon cassette frame 35 has substantially reached the limit of its movement, the engaging pin 69 of the ink ribbon take-up member 37 abuts against the annular ridge 94 of the take-up member drive reel 91, pushing against the resistance of the coil spring 92. At the same time the engaging pin 59 on the ink ribbon supply member 36 abuts against a stepped engagement portion 116 of the supply member engaging reel 115, pushing against the resistance of the coil spring.

In this state, pushing the ink ribbon cassette frame 35 further in, in direction F, brings the rear plate 39 into contact with the limit switch 79. This causes the limit switch 79 to produce an output to the electronic control section 18, which activates the drive motor 84 for a prescribed time. As a result, the take-up member drive reel 91 rotates the ink ribbon take-up member 37 through a prescribed angle in the direction in which the ink ribbon is wound onto the ink ribbon take-up member 37, whereby a prescribed amount of the ink ribbon 29 is wound onto the cylinder 63 of the ink ribbon take-up member 37.

Because of the engagement between the ink ribbon supply member 36 and the supply member engaging reel 115 of the back-tension mechanism 34, a prescribed back tension is thereby imparted to the ink ribbon 29.

Thus, any slack in the ink ribbon 29 between the ink ribbon supply member 36 and the ink ribbon take-up member 37 in the cassette 19 is automatically removed by tensioning the ink ribbon 29.

Figure 13:
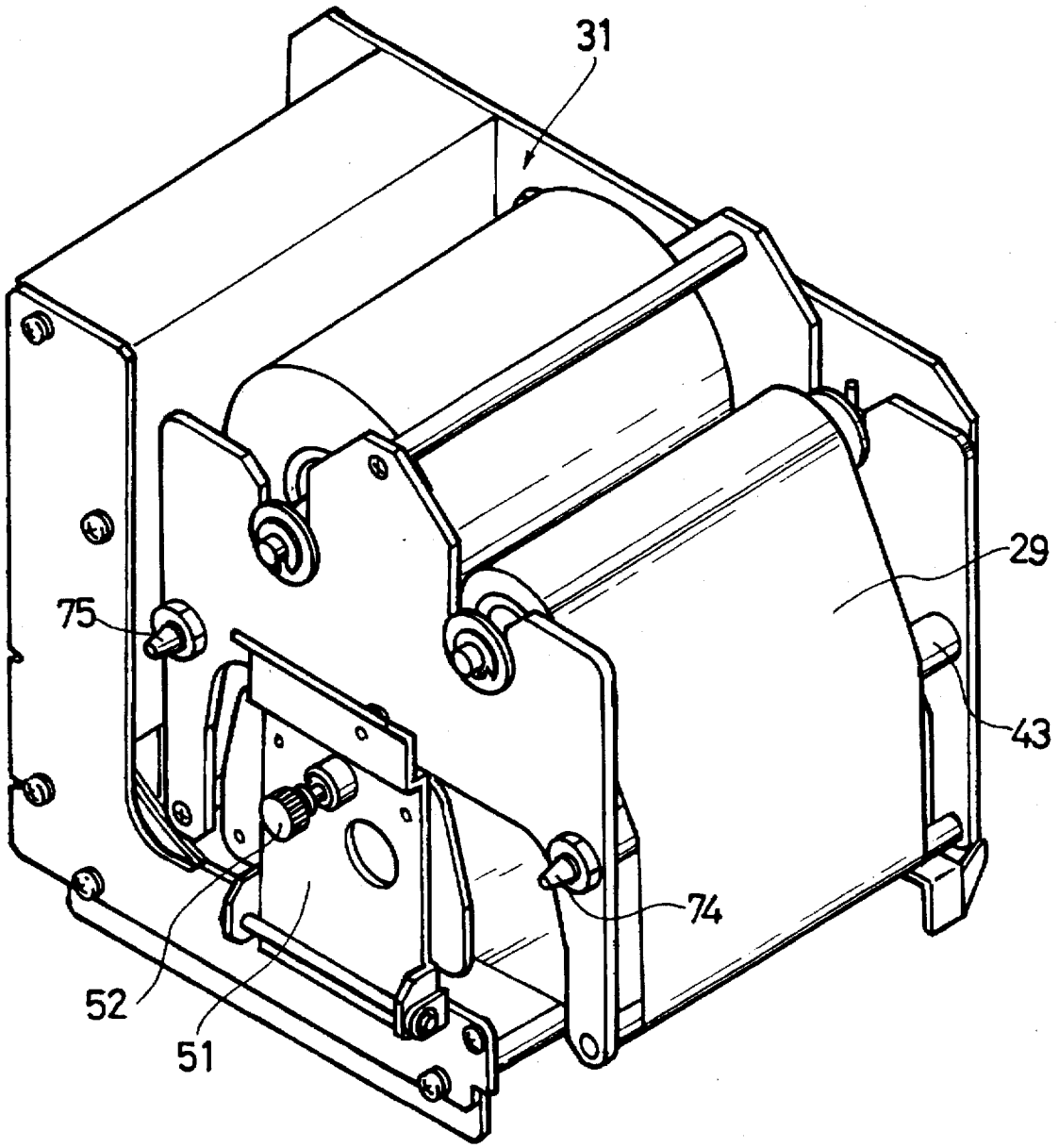
FIG. 13 is a perspective view showing the principal parts of the cassette in place on the cassette mounting mechanism.
Figure 14:
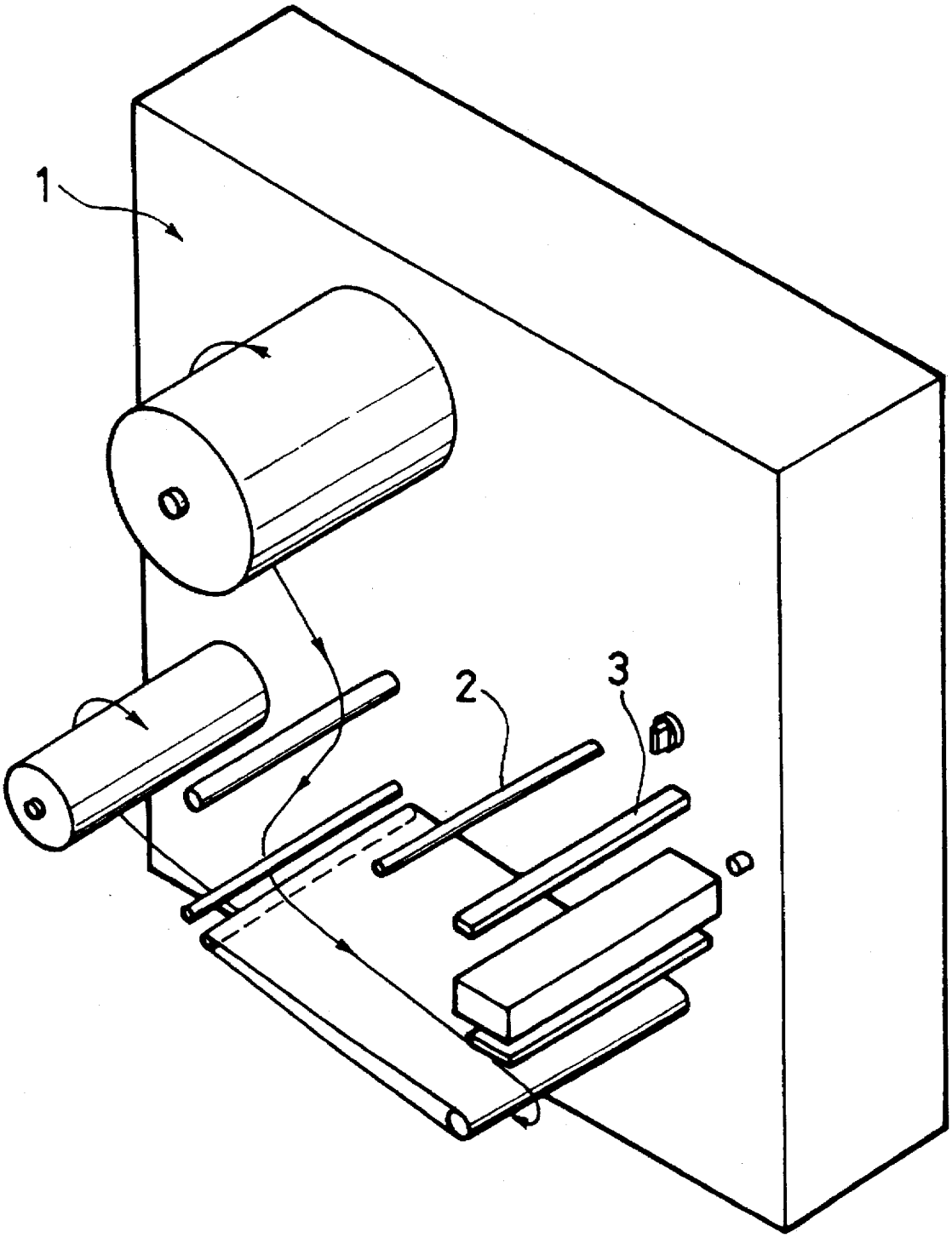
FIG. 14 is a perspective view of a conventional thermal printing apparatus ink ribbon cassette mounting mechanism.
Figure 15:
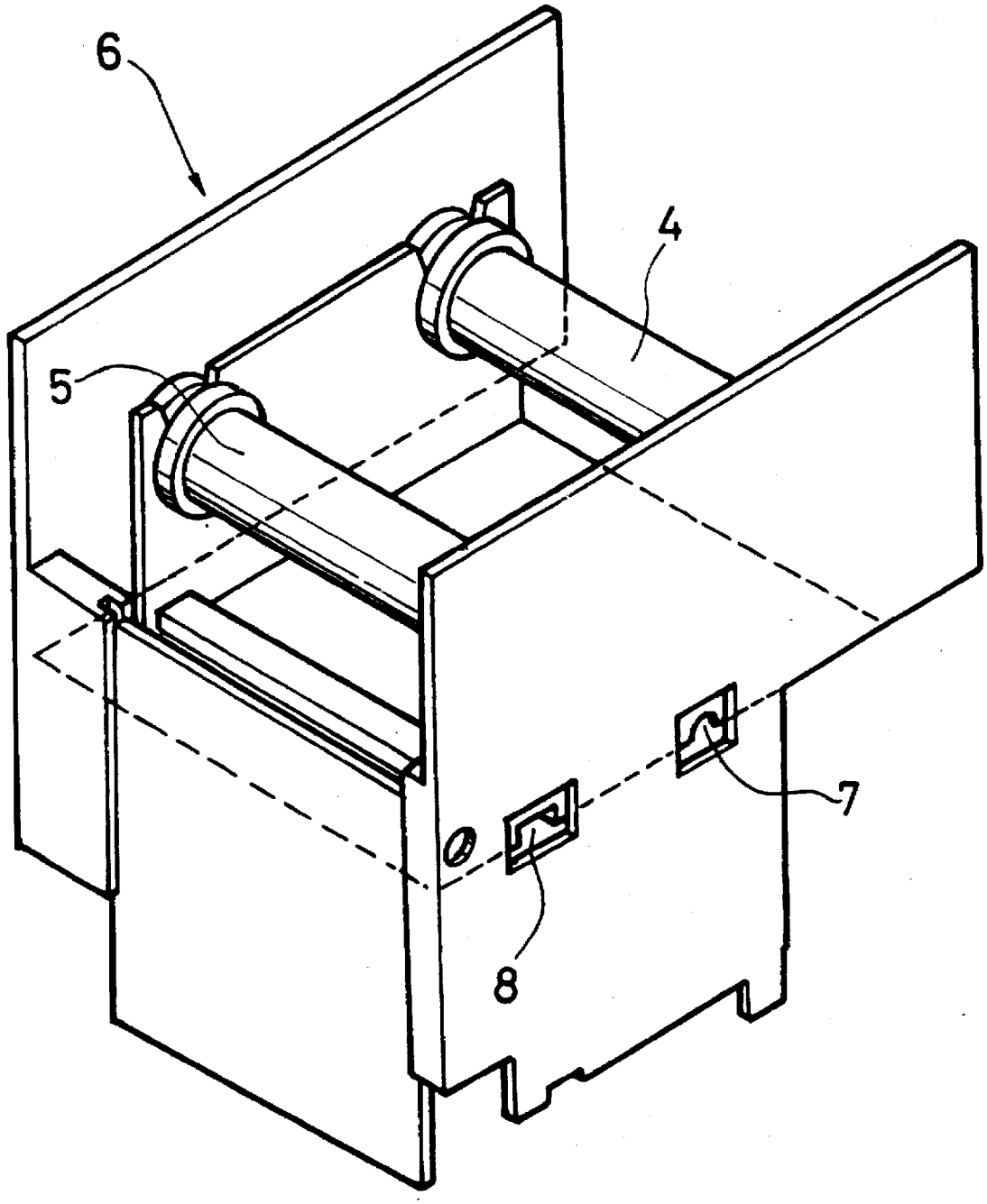
FIG. 15 is a perspective view of a conventional ink ribbon cassette.

The cassette bracket 51 is then pivoted up and the fixing screw 52 screwed into the screw hole 53 on the ink ribbon cassette frame 35. This completes the loading of the ink ribbon cassette 19 onto the main unit 12 (FIG. 13).

Thus, with the ink ribbon cassette apparatus of this invention, when an ink ribbon cassette is loaded into the thermal printer, this is detected by a detection mechanism. The detection mechanism produces an output which causes the ribbon take-up member to be rotated a prescribed angle in the direction in which the ribbon is taken up. Any slack in the ribbon in the cassette therefore can be automatically eliminated, enabling the ribbon cassettes to be replaced quickly and easily.

Obviously, numerous modifications and variations of the present invention are possible in light of the above teachings. It is therefore to be understood that within the scope of the appended claims, the invention may be practiced otherwise than as specifically described within.

What is claimed is:

1. An ink ribbon cassette apparatus for use in a printer employing an ink ribbon, the cassette apparatus comprising:

a cassette; a main unit to which the cassette is detachably mounted;

an ink ribbon supply member supported in the cassette and including a reel for supplying an ink ribbon;

an ink ribbon take-up member supported in the cassette spaced from the supply member and being drivable to take up ribbon thereon from the ink ribbon supply member;

a detector separate from the cassette for detecting that the cassette has been loaded on the main unit;

a drive mechanism connected with the take-up member for driving the take-up member to take up some of the ink ribbon from the supply member, the drive mechanism being connected with the detector for being operated by the detector when the detector senses that the cassette has been loaded on the main unit.

2. In combination, the apparatus of claim 1 and a printer; the printer including means for acting on the ink ribbon for imprinting an imprintable object located at the printer by acting on the ink ribbon along the path of the ink ribbon between the ribbon supply and the ribbon take-up member.

3. The combination of claim 2, wherein the printer is a thermal printer, the ink ribbon is an ink ribbon adapted for use with a thermal printer and the means for imprinting an object is a thermal printer head.

4. The apparatus of claim 1, wherein the detector includes a limit switch, positioned for being contacted by the ink ribbon cassette when the cassette is installed on the main unit and such contact operates the detector.

5. The apparatus of claim 1, wherein the ink ribbon take-up member is supported to rotate with respect to the cassette for taking up the ink ribbon by rotating, and the drive mechanism is operable for driving the take-up member to rotate in the take up direction over a prescribed angle when the detector detects the presence of the cassette on the main unit.

6. The apparatus of claim 5, wherein the drive mechanism detachably engages the ink ribbon take-up member.

7. The apparatus of claim 5, wherein the drive mechanism includes a drive reel that detachably engages the ink ribbon take-up member.

8. The apparatus of claim 7, wherein the drive reel includes an annular projecting portion, and the ink ribbon take-up member has an end thereof which is detachably engageable with the annular projecting portion of the drive reel so that the take-up member is rotated by the drive reel.

9. The apparatus of claim 8, further comprising a ribbon drive mechanism bracket, a shaft mounted on the bracket to be rotated, and the drive reel being mounted on the shaft so that the drive reel can be rotated and moved while on the shaft.

10. The apparatus of claim 8, further comprising an engagement pin on the ink ribbon take-up member which is engageable for rotating the take-up member;

an annular projecting portion on the drive reel, the engagement pin being engageable with the annular projecting portion upon rotation of the annular projecting portion which, through the engagement pin, rotates the ink ribbon take-up member.

11. The apparatus of claim 1, further comprising a back tension mechanism on the cassette and connected with the ink ribbon supply member for resisting the ink ribbon supply member supplying ink ribbon to the ink ribbon take-up member.

12. The apparatus of claim 11, wherein the ink ribbon supply member is supported on the cassette for rotation, whereby the ink ribbon take-up member removes ribbon from the ink ribbon supply member by rotation of the ink ribbon supply member; and the back tension mechanism being connected with the ink ribbon supply member to resist the rotation of the supply member supplying ribbon.

13. The apparatus of claim 12, further comprising tensioning means on the ink ribbon supply member for being tensioned as the ink ribbon rotates to deliver ink ribbon to the ink ribbon take-up member.

14. The apparatus of claim 13, wherein the tensioning means comprises a disk engaging an end of the ink ribbon supply member and a spring resisting rotation of the disk to resist rotation of the supply member.

15. In combination, the apparatus of claim 14, and a printer; the printer including means for acting on the ink ribbon for imprinting an imprintable object located at the printer by acting on the ink ribbon along the path of the ink ribbon between the ribbon supply and the ribbon take-up member.

* * * * *